US009074403B1

(12) United States Patent
Aranda-Sandoval

(10) Patent No.: US 9,074,403 B1
(45) Date of Patent: Jul. 7, 2015

(54) CASHBOX FOR USE WITH A COMPUTER TABLET

(71) Applicant: Gonzalo Aranda-Sandoval, Fresno, CA (US)

(72) Inventor: Gonzalo Aranda-Sandoval, Fresno, CA (US)

( * ) Notice: Subject to any disclaimer, the term of this patent is extended or adjusted under 35 U.S.C. 154(b) by 0 days.

(21) Appl. No.: 13/987,666

(22) Filed: Aug. 19, 2013

(51) Int. Cl.
*E05G 1/026* (2006.01)
*E05G 1/02* (2006.01)

(52) U.S. Cl.
CPC . *E05G 1/026* (2013.01); *E05G 1/02* (2013.01)

(58) Field of Classification Search
CPC ... G06Q 20/206; G06Q 20/18; G07G 1/0018; E05G 1/026; E05G 1/02; G07F 9/10; B41J 29/02; B41J 29/12; B29C 65/18
USPC ..... 221/321 R; 194/346
See application file for complete search history.

(56) References Cited

U.S. PATENT DOCUMENTS 6,490,774 B2 * 12/2002 Carter ..... 29/401.1
2014/0201013 A1 * 7/2014 Dsouza ..... 705/17

* cited by examiner

*Primary Examiner* — Sonji Johnson
(74) *Attorney, Agent, or Firm* — Risto A. Rinne, Jr.

(57) ABSTRACT

An apparatus for the storage of currency and coinage includes a hinged lid pivotally attached to a bottom portion. An inner portion of the lid is able to receive an IPAD™ or other tablet. A first inner hinged plate secures the IPAD™ or tablet in position and includes a center opening that allows viewing of a display screen. A cash drawer that includes slanted currency slots is removable from the bottom portion. A second inner hinged plate covers and prevents viewing of the contents of the cash drawer. A front lock secures the hinged top to the bottom portion. A top lock secures the first inner hinged plate to the hinged top. An arcuate opening in the first inner hinged plate provides access to an on/off switch. An extension plug passes through a hole in a sidewall of the hinged top for connection of a card swiping device.

11 Claims, 2 Drawing Sheets

CASHBOX FOR USE WITH A COMPUTER TABLET

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to cashboxes and, more particularly, to a cashbox for a tablet computer. As used herein, the term "tablet" includes any mobile electronic computing device with a touch-sensitive screen, such as an IPAD™ or any version of an IPAD™ or similar product produced by any manufacturer.

Cashboxes are well known devices used at point of sale terminals to store currency bills and coinage. They include small and portable cashboxes as well as larger, less portable types of devices.

There is a growing need for a portable type of a cashbox that can be used with an IPAD™ or other portable computer tablet. These types of devices are ever more commonly being used at point-of-sale (POS) retail locations.

The locations may include businesses with a fixed storefront or mobile businesses, such as a farmer's market and many others, as well. Most types of retail businesses generally receive a mixture of cash, debit cards, and credit cards.

When the seller must process either a debit or credit card, some means of electronically clearing the funds at the point-of-sale (POS) location is typically required. A card swiping device, also sometimes referred to as a "cube" is available for plug-in use with an IPAD™ or with certain other electronic tablets. Accordingly, the IPAD™ or electronic tablet must include some means of accessing the Internet. Typically, the means will be wireless, such as via WI-FI™, linkage to a cell phone tower, or by any other means. For fixed location storefronts, Internet access could be detachably hardwired to the IPAD™ or electronic tablet, for example, to a USB™ port. It is important to preserve portability of the cashbox and IPAD™ or electronic tablet even at fixed location storefronts. This is because it is desirable to be able to quickly and easily move the IPAD™ or electronic tablet and cashbox, together as an assembly, for safe storage and possible assorting of cash and other receipts.

Whenever these, or other types of businesses, must deal with cash and debit cards and/or credit cards, a means for storing cash and processing the debit or credit card transactions is necessary.

Many merchants with a fixed storefront would also prefer to eliminate a bulky cash register or a larger type of cashbox, preferring to use any space that can be saved for the display of additional goods for sale.

Even though cashboxes and IPAD™ types of computer tablets are well known and presently address certain aspects of these needs, there are significant deficits with the currently available solutions.

For example, when a credit card is processed using an IPAD™, the purchaser must typically "sign" an authorization field that is shown on a touch screen of an IPAD™ using a non-writing type of pen. If the IPAD™ is supported or attached to a prior art type of cashbox, this involves turning the prior art cashbox around 180 degrees so that the purchaser can sign the screen. Similarly, if a debit card is used a numeric field is presented for the purchaser to enter a PIN number. This, again, requires rotating the prior art cashbox and IPAD™ 180 degrees toward the purchaser.

Either way, the cashbox is turned around to face the purchaser. This may present cash or other receipts that are in the cashbox in front of the purchaser, which is undesirable. There arises a risk of providing confidential information about earlier transactions to others and even inviting theft, should the retailer become distracted.

Accordingly, there is a need to allow purchasers to provide a signature authorizing a credit card transaction or enter a PIN on an IPAD™ or other type of tablet that does not require a 180 degree turning of a cashbox to which the IPAD™ or tablet is attached.

Also, with prior art types of cashboxes that are intended to cooperate with an IPAD™ or other type of tablet, there is a need to quickly provide some sort of a covering that hides cash and coinage from public view. Ideally, the normal state of cash and coinage would be not visible. Such a covering, ideally, would not affect positioning, access, or usage of the IPAD™ or tablet.

Additionally, there is a need to secure an IPAD or other tablet to a cashbox in a way that prevents unauthorized removal of the IPAD™ or tablet from the cashbox. This is a problem with prior art designs that do not secure the IPAD™ or other type of tablet sufficiently well to the cashbox. As a result, should the merchant become distracted, especially during crowded conditions, the IPAD™ or tablet can easily be stolen from prior art types of cashboxes.

There is also a need to minimize the size of the cashbox. This is difficult to accomplish because several storage compartments for various different denominations of currency (i.e., bills) are needed, as well as for coinage. Prior art attempts to minimize compartment size for a cashbox has resulted in difficulty in removing bills from the cashbox, as is necessary when making change.

Additionally, prior art devices do not surround the back and four sides of an IPAD™ or other tablet and still allow access to a port on the IPAD™ or other tablet which permits connection of the card swiping device. This is because the surrounding sides would prevent insertion of the card swiping device into the appropriate port.

Ideally, it is desirable to surround an IPAD™ or other tablet on a back and all four sides to better secure the IPAD™ or other tablet to a small, portable cashbox and to also permit easy connection of a card swiping device, as well. Such connection could be used to better secure the IPAD™ or other tablet to the cashbox, thereby further deterring theft or accidental discharge from the cashbox.

Accordingly, there exists today a need for a cashbox for use with a computer tablet that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Cashboxes are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 8,235,287 to McKelvey, that issued on Aug. 7, 2012;

U.S. Pat. No. 6,637,946 to Cheng, that issued on Oct. 28, 2003;

U.S. Pat. No. 6,600,826 to Xavier, that issued on Jul. 29, 2003;

U.S. Pat. No. 5,710,415 to Kono, et al., that issued on Jan. 20, 1998;

U.S. Pat. No. 5,520,286 to Murakoshi, et al., that issued on May 28, 1996;

U.S. Pat. No. 5,058,765 to Gomi, et al., that issued on Oct. 22, 1991;

U.S. Pat. No. 4,803,728 to Lueken, that issued on Feb. 7, 1989;

U.S. Pat. No. 4,280,034 to Ezaki, et al., that issued on Jul. 21, 1981;

U.S. Pat. No. 2,508,981 to Williams, that issued on May 23, 1950;

U.S. Pat. No. 1,901,533 to Preddey, that issued on Mar. 14, 1933; and

U.S. Pat. No. 1,857,305 to Holliday, that issued on May 10, 1932.

And including U.S. Patent Application Publication:

U.S. Patent Application Publication No. US 2010/0180804 to Czarnecki, et al. that published on Jul. 22, 2010.

And including U.S. Design Patent:

U.S. Design Pat. No. Des. 406,270 to Postrel, et al., that issued on Mar. 2, 1999.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

Objects and Summary of the Invention

It is an object of the present invention to provide a cashbox for use with a computer tablet that is portable.

It is also an important object of the invention to provide a cashbox for use with a computer tablet that secures the tablet to the cashbox.

Another object of the invention is to provide a cashbox for use with a computer tablet that surrounds a back and four sides of the tablet in a compartment provided in the cashbox.

Still another object of the invention is to provide a cashbox for use with a computer tablet that permits presentation of a touch-sensitive screen of the tablet to a customer without allowing access to cash that is disposed in the cashbox.

Still yet another object of the invention is to provide a cashbox for use with a computer tablet that permits presentation of a touch-sensitive screen of the tablet to a customer without rotating the cashbox about a vertical axis passing through the cashbox.

Yet another important object of the invention is to provide a cashbox for use with a computer tablet that includes a hinged panel which is normally disposed over cash and receipts that are stored in the cashbox.

Still yet another important object of the invention is to provide a cashbox for use with a computer tablet that that surrounds a back and four sides of the tablet in a compartment provided in a lid of the cashbox.

A first continuing object of the invention is to provide a cashbox for use with a computer tablet that includes a lockable hinged top, wherein the lockable hinged top can be locked to a bottom portion of the cashbox.

A second continuing object of the invention is to provide a cashbox for use with a computer tablet that includes a first inner hinged plate, wherein the first inner hinged plate includes a top lock for locking the first inner hinged plate to a hinged top of the cashbox.

A third continuing object of the invention is to provide a cashbox for use with a computer tablet that includes a first inner hinged plate, wherein the first inner hinged plate includes an opening in a center thereof to permit viewing of a touch sensitive screen of an IPAD™ or other type of computer tablet or making contact with the screen.

A fourth continuing object of the invention is to provide a cashbox for use with a computer tablet that includes an especially compact cash drawer that allows for the easy extraction of currency and coinage, and wherein the cash drawer can be removed from a bottom portion of the cashbox.

A fifth continuing object of the invention is to provide a cashbox for use with a computer tablet that includes a second inner hinged plate, wherein the second inner hinged plate includes a solid planar member which is able to pivot into a closed position, wherein when the second inner hinged plate is disposed in the closed position it is disposed over a top surface of a bottom portion of the cashbox and parallel with a bottom planar member of the cashbox, and wherein the solid planar member is able to pivot into an open position, wherein when the second inner hinged plate is disposed in the open position the second inner hinged plate is disposed at an angle with respect to the bottom planar member, and wherein when the second inner hinged plate is disposed in the open position the second inner hinged plate is disposed sufficiently far above the top surface of the bottom portion of the cashbox to permit access to a cash drawer that is disposed in the bottom portion of the cashbox.

A sixth continuing object of the invention is to provide a cashbox for use with a computer tablet that includes a cash drawer, wherein the cash drawer can be removed from a bottom portion of the cashbox, and wherein the cash drawer includes a plurality of compartments for storing currency bills and/or coinage in certain of the compartments, and wherein at least some of the compartments include sidewalls that are disposed at an angle of inclination with respect to a bottom member of the cash drawer other than parallel and other than perpendicular, and wherein the currency bills are disposed at the angle of inclination when they are placed in certain of the compartments.

A seventh continuing object of the invention is to provide a cashbox for use with a computer tablet that includes an opening provided through a sidewall of a hinged top, and wherein the opening aligns with a port of the tablet.

An eighth continuing object of the invention is to provide a cashbox for use with a computer tablet that includes a hole provided in a sidewall of a hinged top, and wherein the hole aligns with a port of the tablet, and wherein the cashbox includes an extension plug, and wherein the extension plug is able to be inserted through the hole in the sidewall and into the port of the tablet, and wherein an opposite end of the extension plug is able to receive a credit card or a debit card reading device therein, sufficient to electrically connect the credit card or a debit card reading device to the tablet.

A ninth continuing object of the invention is to provide a cashbox for use with a computer tablet that includes an arcuate opening provided through a first inner plate, wherein the arcuate opening is disposed over an on/off switch or button of a tablet that is disposed in an interior portion of a hinged top.

A tenth continuing object of the invention is to provide a cashbox for use with a computer tablet that helps to prevent theft of an IPAD™ or other type of tablet from the cashbox.

Briefly, a cashbox for use with a computer tablet that is constructed in accordance with the principles of the present invention has a cash drawer that is removable from a bottom portion of the cashbox. The cash drawer includes four slanted bill slots that are each able to receive a particular denomination of currency therein. Four coin compartments are provided to receive various coin denominations, therein. A hinged top that includes a planar top member and four perpendicular sidewalls, attached thereto, is hingedly attached to the bottom portion of the cashbox. An interior portion of the hinged top is sized to receive an IPAD™ or other tablet therein. A first inner hinged plate is hingedly attached to the bottom portion of the cashbox proximate where the hinged top is hingedly attached. The first inner hinged plate includes a top lock for securing the first inner hinged plate in a closed position where the first inner hinged plate is disposed adjacent to and parallel with the hinged top. The first inner hinged plate additionally includes a center opening that permits viewing and contact with a touch-sensitive screen of the tablet when the tablet is disposed in the interior portion of the hinged top and when the top lock is secured to the hinged top. The first inner hinged plate also includes an arcuate opening that is disposed over an on-off button/switch of the tablet when the tablet is disposed in the interior portion of the hinged top. The top lock also secures the IPAD™ or other type of tablet in the interior portion of the hinged top, thereby helping to prevent theft of the IPAD™ or other type of tablet from the cashbox. A front lock secures the hinged top in a closed position when the cashbox is not being used. A second inner hinged plate is hingedly attached to the bottom portion proximate to where the first inner hinged plate is hingedly attached to the bottom portion. The second inner hinged plate includes a solid planar member that is able to pivot from a closed position into an open position. When the second inner hinged plate is disposed in the closed position, it is disposed over a top surface of the bottom portion of the cashbox parallel with respect to a bottom planar member of the cashbox, and over the cash drawer and is, therefore, able to conceal from view any currency or coinage that is disposed in the cash drawer. The closed position is the normal position for the second inner hinged plate. When the second inner hinged plate is disposed in the open position, it is disposed at an angle with respect to the bottom planar member, and wherein when the second inner hinged plate is disposed in the open position, the second inner hinged plate is disposed sufficiently far above the top surface of the bottom portion of the cashbox to permit access to a cash drawer that is disposed in the bottom portion of the cashbox or to permit removal of the cash drawer from the bottom portion or replacement of the cash drawer into the bottom portion. A hole is provided through one of the sidewalls of the hinged top, and wherein the hole aligns with a port of the tablet and wherein an extension plug is provided that is able to be inserted through the hole in the sidewall and wherein a first end of the extension plug is able to be inserted into the port of the tablet, and wherein an opposite end of the extension plug is able to receive a credit card or a debit card reading device therein, and wherein the extension plug is able to electrically connect the credit card or a debit card reading device to the tablet. The hinged top includes a partially open position where a first half of the front lock is disposed a first intermediate distance away from a second half of the front lock. The hinged top pivots about a hinge axis and includes a fully open position where the first half of the front lock is disposed a second distance that is maximally away from the second half of the front lock. When the hinged top is disposed in the fully open position, the IPAD™ or other tablet is disposed in an upside-down orientation as compared to the IPAD™ or other tablet's position when the hinged top is disposed in the partially open position. The IPAD™ or other tablet is able to sense the upside down orientation of itself and automatically invert the image shown on the screen. Accordingly, the fully open position of the hinged top provides opportunity for a customer to sign an authorization signature field that is provided on the screen of the IPAD™ or other tablet and approve a credit card transaction or for the customer to enter a personal identification number (PIN) on a PIN field that is provided on the screen to accomplish a debit card transaction without permitting easy access to or viewing of the contents of the cash drawer. The contents of the cash drawer remain hidden from view of the customer by ensuring that the second inner hinged plate is disposed in the closed position whenever the hinged top is disposed in the fully open position.

DETAILED DESCRIPTION OF THE INVENTION

Figure 1:
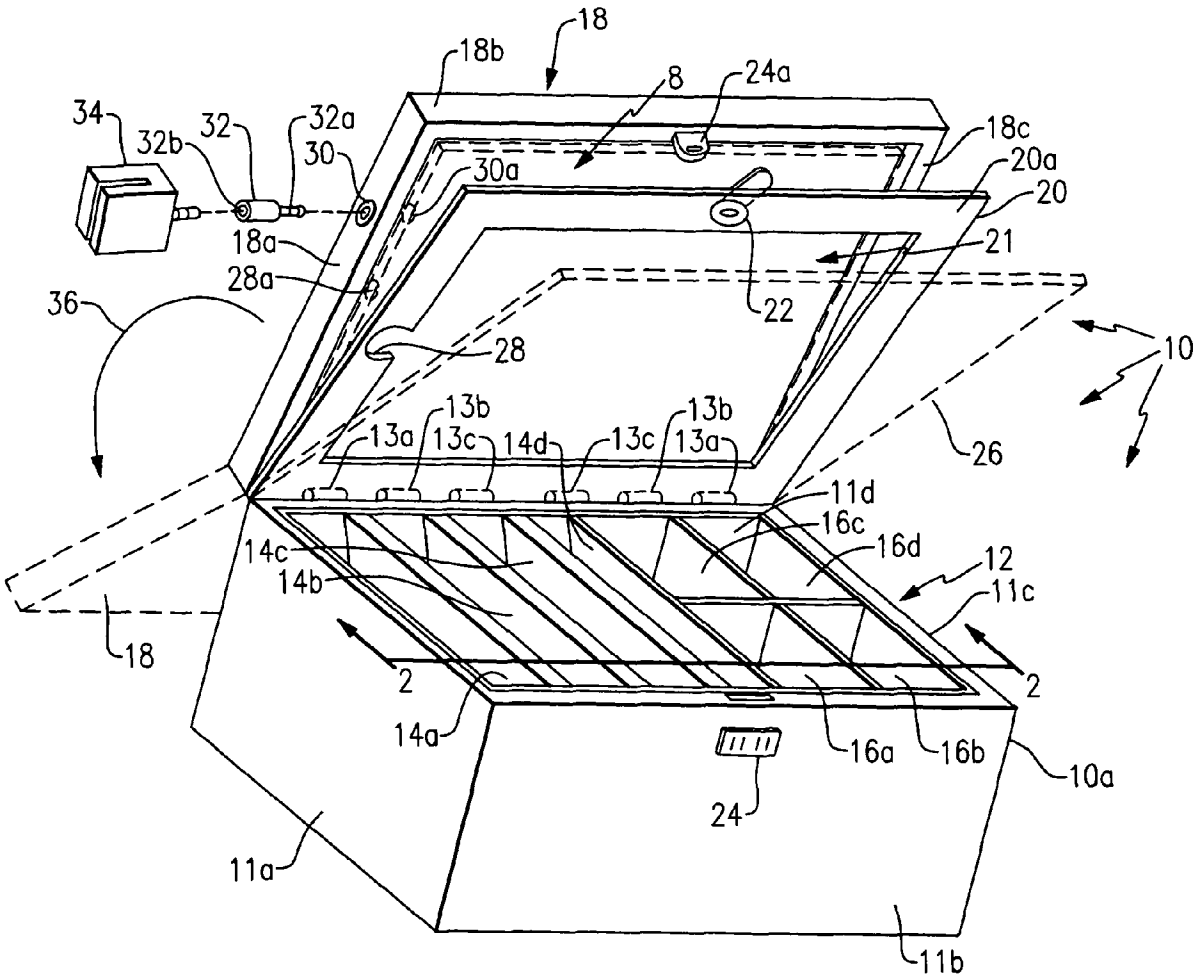
FIG. 1 is a view in perspective of a cashbox for use with a computer tablet.

Referring on occasion to both of the FIGURE drawings and now, in particular to FIG. 1, is shown a cashbox for use with a computer tablet, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The cashbox 10 includes a cash drawer, identified in general by the reference numeral 12. The cash drawer 12 is removable from a bottom portion 10*a* of the cashbox 10 by lifting the cash drawer 12 up out of the bottom portion 10*a* after ensuring that the cashbox 10 is disposed in an open position. The open position of the cashbox 10 is described in greater detail, hereinafter.

Conversely, to install the cash drawer 12 in the cashbox 10 it is lowered into the bottom portion 10*a* when the cashbox 10 is in the open position.

Figure 2:
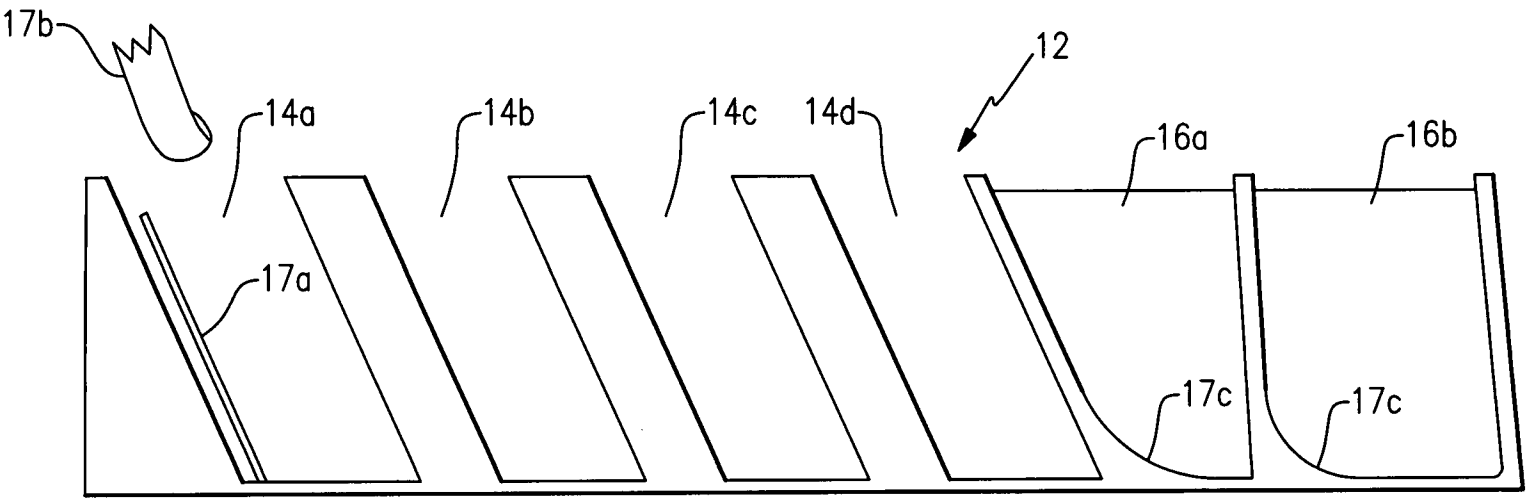
FIG. 2 is a cross-sectional view of the cashbox of FIG. 1 taken along the line 2-2 of FIG. 1.

Referring now to FIG. 2, a cross-sectional view of the cash drawer 12 is shown. The cash drawer 12 has been removed from the bottom portion 10*a*. Accordingly, the cash drawer 12 can be removed from a remainder of the cashbox 10, as desired, for any desired purpose.

The cash drawer 12 includes four slanted bill slots 14*a*, 14*b*, 14*c*, 14*d* that are each able to receive a particular denomination of currency, therein. Four coin compartments 16*a*, 16*b*, 16*c*, 16*d* (16*c* and 16*d* are visible in FIG. 1) are provided to receive various coin denominations, therein.

It is to be noted that one of the slanted bill slots 14*d* extends under a portion of two of the coin compartments 16*a*, 16*d*. This is done to maximally save space. A width of each of the slanted bill slots 14*a*, 14*b*, 14*c*, 14*d* across the bottom flats of each is preferably one inch, which further limits the overall size of the cash drawer 12.

Also, as viewed from FIG. 2, a one-dollar bill 17*a* or any other denomination of currency will tend to rest on the left-hand side of each of the slanted bill slots 14*a*, 14*b*, 14*c*, 14*d*. This allows for easy insertion of a fingertip 17*b* in each of the slanted bill slots 14*a*, 14*b*, 14*c*, 14*d* when the fingertip is inserted from the top and offset to the right-hand side of each of the slanted bill slots 14*a*, 14*b*, 14*c*, 14*d*.

During use, the fingertip 17*b* is then urged to the left to bear against the one-dollar bill 17*a* and to urge the one-dollar bill 17*a* toward the left-side of its slanted bill slot 14*a*. The fingertip 17*b* is then raised upward which also extracts the one-dollar bill 17*a* out of the slanted bill slot 14*a*. The same extraction method is used for other denominations of currency that are disposed in any of the remaining slanted bill slots 14*b*, 14*c*, 14*d*.

The coin compartments 16*a*, 16*b*, 16*c*, 16*d* are sized to permit insertion of the fingertip 17*b* all the way to the bottom of each coin compartment 16*a*, 16*b*, 16*c*, 16*d*. A curvature 17*c* is provided at the bottom-left side of each coin compartment 16*a*, 16*b*, 16*c*, 16*d*. The fingertip 17*b* makes contact with any desired coin (not shown) in any of the coin compartments 16*a*, 16*b*, 16*c*, 16*d* and urges it to the left. The coin gently rides up along the curvature 17*c* and up the left-hand side of each of the coin compartments 16*a*, 16*b*, 16*c*, 16*d* for easy removal.

This particular arrangement of the slanted bill slots 14*a*, 14*b*, 14*c*, 14*d* and the coin compartments 16*a*, 16*b*, 16*c*, 16*d* overcomes two prior-art cash drawer (not shown) problems simultaneously. It allows for storage of the four most common currency denominations used in retail transactions ($1, $5, $10, and $20 denominations) and for the four most common coin denominations (pennies, nickels, dimes, and quarters) in the smallest possible footprint.

Accordingly, the cash drawer 12 dimensions are only about two inches high by about nine and one-tenth of an inch wide by about seven and one-quarter inches deep. This, in turn, permits manufacture and use of the very small cashbox 10 as the interior dimensions of the bottom portion 10*a* can be greatly reduced so that they only slightly exceed the exterior dimensions of the cash drawer 12.

No known prior art type of cash drawer (not shown) has included a size this small and still allow for rapid currency and coin insertion and removal. Speed is especially important in retail sales because it is highly desirable to decrease the time required to complete each transaction. The design of the cash drawer 12 and use of the fingertip 17*b*, as described, provides for especially rapid coin and currency removal, something that has not heretobefore been possible in such a small size of removable cash drawer 12 for use in such a small size of cashbox 10.

Being removable, additional spare (not shown) cash drawers 12 could be purchased or provided. Each additional spare cash drawer 12 could be preloaded with a desired amount of currency and coinage to make change during normal retail sales. In this manner, as sales progressed and the cash drawer 12 began to fill with currency and/or coinage it could be removed and immediately replaced with the spare cash drawer 12. This would prevent increasing time for each transaction as a result of overcrowding occurring in the slanted bill slots 14*a*, 14*b*, 14*c*, 14*d* and/or in the coin compartments 16*a*, 16*b*, 16*c*, 16*d*.

Referring again primarily to FIG. 1, a hinged top, identified in general by the reference numeral 18, is pivotally attached to a top of a rear side member 11*d* of the bottom portion 10*a* of the cashbox 10 by a first pair of hinges 13*a* (dashed lines). The hinged top 18 pivots around a first longitudinal axis that passes through the first pair of hinges 13*a*.

The bottom portion 10*a* includes three additional side members 11*a*, 11*b*, 11*c* and a planar bottom member (not shown) that is disposed at a bottom of the cashbox 10 and which extends between the four side members 11*a*-11*d*, thereby enclosing the bottom of the cashbox 10. The bottom portion 10*a* provides a box-like enclosure with an open-top.

The hinged top 18 includes a planar top member and four raised perpendicular surrounding sidewalls (only three of which 18*a*, 18*b*, 18*c* are shown, 18*d* is hidden from view at the bottom of the hinged top 18). The four sidewalls 18*a*-18*d* are disposed at a perimeter of the planar top member. An interior portion of the hinged top 18 includes a space between the fours sidewalls 18*a*-18*d* and the planar top member.

The bottom portion 10*a* or any component part of the cashbox 10 includes any desired material and is formed or assembled by any preferred method. For example, any portion of the cashbox 10 may be molded out of any desired material, such as plastic, fiberglass or other material. Wood could be used for its construction. Similarly, steel or any other metal may be used and welded together. The use of composite materials is also possible. As desired, any of the component parts of the cashbox 10 may be selected to provide any desired degree of ruggedness, aesthetic appeal, or resistance to forced entry, as may be desired.

The interior portion of the hinged top 18 is sized to receive an IPAD™ (partially shown in dashed lines and identified in general by the reference numeral 8) or it is sized to receive any other type of tablet, therein. During use, the IPAD™ 8 is placed in the interior portion with a display screen of the IPAD™ 8 facing downward, toward the bottom portion 10*a* of the cashbox 10.

A first inner hinged plate 20 is pivotally attached to the top of the rear side member 11*d* of the bottom portion 10*a* of the cashbox 10 by a second pair of hinges 13*b* (dashed lines). The first inner hinged plate 20 pivots around a second longitudinal axis that passes through the second pair of hinges 13*b*.

The first inner hinged plate 20 includes a top lock 22 for securing the first inner hinged plate 20 in a closed position in which the first inner hinged plate 20 is disposed adjacent to and parallel with the hinged top 18. A protruding portion of the top lock 22 engages with a recess (not shown) that is provided in an interior of one of the sidewalls 18*b*.

The first inner hinged plate 20 additionally includes a center opening, identified in general by the reference numeral 21, that that permits viewing and contact with a touch-sensitive screen of the IPAD™ 8 when the IPAD™ 8 is disposed in the interior portion of the hinged top 18 and when the top lock 22 is secured to the hinged top 18. The first inner hinged plate 20 also includes an arcuate opening 28 that is disposed over an on-off button/switch 28*a* of the IPAD™ 8 when the IPAD™ 8 is disposed in the interior portion of the hinged top 18.

The top lock 22, by securing the first inner hinged plate 20 to the hinged top 18, also secures the IPAD™ 8 or other type of tablet in the interior portion of the hinged top 18, thereby helping to prevent theft of the IPAD™ 8 or other type of tablet from the cashbox 10. A perimeter frame 20*a* of the first inner hinged plate 20 provides mechanical means for securing the IPAD™ 8 to the cashbox 10.

A two piece front lock 24, 24*a* secures the hinged top 18 to the top of the front side member 11*b* of the bottom portion 10*a*. A first half of the front lock 24*a* is attached to a front one of the sidewalls 18*b*. A second half of the front lock 24 is attached to a top of the front side member 11*b*. The front lock 24, 24*a* prevents rising of the hinged top 18 by unauthorized people. When the hinged top 18 is secured to the bottom portion 10*a*, the cashbox 10 is disposed in a closed and locked position. The cashbox 10 is disposed in the closed and locked position when it is not being used.

A second inner hinged plate 26 (shown in dashed lines for enhanced clarity of view of other component parts) is pivotally attached to the top of the rear side member 11*d* of the bottom portion 10*a* of the cashbox 10 by a third pair of hinges 13*c* (dashed lines). The second inner hinged plate 26 pivots around a third longitudinal axis that passes through the third pair of hinges 13*c*.

To allow sufficient clearance for pivoting of the hinged top 18, the first inner hinged plate 20, and the second inner hinged plate 26, a slight offset in position between each of the first, second and third pairs of hinges 13*a*, 13*b*, 13*c* is provided.

The second inner hinged plate 26 includes a solid opaque planar member that is able to pivot from a closed position into an open position. When the second inner hinged plate 26 is disposed in the closed position, it is disposed over a top surface of the bottom portion 10*a* of the cashbox 10 parallel with respect to the bottom planar member of the cashbox 10, and also over the cash drawer 12. The second inner hinged plate 26 is, therefore, able to conceal from view any currency or coinage that is disposed in the cash drawer 12.

The closed position is the normal position for the second inner hinged plate 26. When the second inner hinged plate 26 is disposed in the open position, it is disposed at an angle with respect to the bottom planar member, and wherein when the second inner hinged plate 26 is disposed in the open position the second inner hinged plate 26 is disposed sufficiently far above the top surface of the bottom portion 10*a* to permit access to the cash drawer 12 that is disposed in the bottom portion 10*a* of the cashbox 10 or to permit removal of the cash drawer 12 from the bottom portion 10*a* or replacement of the cash drawer 12 into the bottom portion 10*a*.

A hole 30 is provided through one of the sidewalls 18*a* of the hinged top 18. The hole 30 aligns with a port 30*a* of the IPAD™ 8. An extension plug 32 is provided that fits in the hole 30. A first end 32*a* of the extension plug 32 is able to be inserted into the port 30*a* of the IPAD™ 8. An opposite end 32*b* of the extension plug 32 is able to receive a credit card or a debit card reading device 34 therein.

The extension plug 32 is able to electrically connect the credit card or a debit card reading device 34 to the port 30*a* of the IPAD™ 8. Absent the extension plug 32 the credit card or a debit card reading device 34 would not electrically interface with the port 30*a*. Additionally, the extension plug 32 provides additional mechanical means for securing the IPAD™ 8 to the hinged top 18 of the cashbox 10.

The hinged top 18 pivots about the first pair of hinges 13*a* and includes a partially open position where a first half of the front lock 24*a* is disposed at a first intermediate distance away from the second half of the front lock 24. The partially open position of the hinged top 18 is shown in FIG. 1 in solid lines. The hinged top 18 also includes a fully open position where the first half of the front lock 24*a* is disposed maximally away from the second half of the front lock 24. To place the hinged top 18 in the fully open position it is rotated in the direction shown by arrow 36 until the front one of the sidewalls 18*b* makes contact with a surface that the cashbox 10 is placed upon. The fully open position of the hinged top 18 is shown in FIG. 1 in dashed lines.

When the hinged top 18 is disposed in the fully open position, the IPAD™ 8 or other tablet is disposed at an incline that is upside-down as compared to an incline of the IPAD™ 8 (or other tablet's) when the hinged top 18 is disposed in the partially open position. The IPAD™ 8 or other tablet is able to sense the change from a more right-side up orientation into a more upside down orientation and will automatically invert any image that is shown on its display screen.

During use, the hinged top 18 is normally disposed in the partially open position to permit the retailer using the cashbox 10 clear view of the display screen of the IPAD™ 8 and to block such view from the customer. When dealing with credit card or debit card transactions, the retailer will swipe the credit or debit card through the credit card or a debit card reading device 34 to initiate the transaction.

At some point in time, the customer may need to sign an authorization signature field that is provided on the touch-sensitive display screen of the IPAD™ 8 (as generated by software that works in conjunction with the credit card or a debit card reading device 34) in order to legally authorize and complete a credit card transaction. Similarly, at some point in time the customer may need to enter a personal identification number (PIN) on a PIN entry field that is provided on the display screen of the IPAD™ 8 to complete a debit card transaction.

However, the retailer does not want to provide easy access to, or possible viewing of, the contents of the cash drawer 12 to the customer to prevent theft of the contents or dissemination and compromise of personal information from any previous customer if any transaction receipts are also stored in the cash drawer 12.

When the customer needs to sign the authorization signature field on the display screen or enter the PIN on the PIN entry field, the retailer first ensures that the second inner hinged plate 26 is disposed in the closed (i.e., lowered) position and then places the hinged top 18 into the fully open position by urging the hinged top 18 in the direction as shown by arrow 36. When the hinged top 18 is disposed in the fully open position the image on the display screen automatically inverts, thereby allowing the customer to sign the authorization signature field or enter their PIN with ease.

The contents of the cash drawer 12 remain completely hidden from view of the customer by ensuring that the second inner hinged plate 26 is disposed in the closed position whenever the hinged top 18 is disposed in the fully open position.

Accordingly, the cashbox 10 overcomes the prior art problem of placing currency proximate a customer during signature or PIN entry and the cashbox 10 also overcomes the prior art problem of possibly exposing the sensitive private information of earlier customers to other customers.

The first pair of hinges 13*a* include sufficient inherent friction to maintain the hinged top 18 in any preferred position. When movement of the hinged top 18 is desired, the retailer applies additional force, as necessary, to pivot the hinged top 18 into any desired position.

If desired, additional ports of the IPAD™ 8 or other type of tablet can be used to connect a receipt printer (not shown) or other device to the IPAD™ 8 or tablet. Additional or slightly modified versions (not shown) of the extension plug 32 would be provided for this purpose.

If desired, the cashbox 10 can be placed on any desired flat surface, such as a table (not shown), or the cashbox 10 can be placed on a stand (not shown) to elevate the cashbox 10 above an elevation of a surrounding surface. If desired, the cashbox 10 can be secured to the table or stand by attaching any desired type of hardware to the cashbox 10 and to the table or stand to further deter theft of the cashbox 10 or its contents.

Accordingly, a complete and exceptionally small and compact portable cashbox 10 is provided that satisfies objects of the instant invention as well as other possible objects not mentioned specifically herein.

To remove or insert the cash drawer 12 from the bottom portion 10*a*, the cashbox 10 is first disposed in the open position by urging the hinged top 18 into the fully open position as shown by arrow 36 and also by urging the second inner hinged plate 26 into its fully open position. If desired, the second pair of hinges 13*b* of the first inner hinged plate 20 may be attached to the bottom sidewall 18*d* of the hinged top 18 instead of to the rear side member 11*d* of the bottom portion 10 to facilitate rotation of the first inner hinged plate 20 as the hinged top 18 is pivoted.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A cashbox for use with a computer tablet, comprising:

a bottom portion that includes a planar bottom member and four upright opposing side members that include a rear side member, a front side member and two remaining side members, wherein said side members are attached to a perimeter of said planar bottom member and wherein said bottom portion includes an open top; (b) a cash drawer that is sized to pass through said open top of said bottom portion and to fit into said bottom portion and to be removed apart from said bottom portion;

(c) a hinged top that is pivotally attached to a top of said rear side member by one or more first hinges, and wherein said hinged top includes four opposing sidewalls that are each disposed at a perimeter of a planar top member, and wherein a space between said four sidewalls and said planar top member includes an interior portion of said hinged top, and wherein said interior portion receive an electronic computing tablet therein, and wherein said hinged top pivots between a closed position in which said hinged top is disposed over said bottom portion and said planar top member of said hinged top is parallel with respect to said bottom member of said bottom portion, and a partially open position in which said planar top member of said hinged top is disposed at a first incline with respect to said bottom member, and a fully open position in which said planar top member of said hinged top is disposed at a second incline with respect to said bottom member, and wherein said electronic computing tablet is disposed in a right-side-up orientation when said hinged top is disposed in said partially open position and wherein said electronic computing tablet is disposed in an upside-down orientation when said hinged top is disposed in said fully open position; and (d) a first inner hinged plate that is pivotally attached to said top of said rear side member by one or more second hinges, and wherein said first inner hinged plate includes a top lock and wherein said top lock is configured to secure said first inner hinged plate in a closed position after said electronic computing tablet is disposed in said interior portion, and wherein when said first inner hinged plate is disposed in said closed position it is disposed adjacent to said hinged top, and wherein said first inner hinged plate includes a perimeter frame that surrounds a center opening, and wherein said center opening provides access to and viewing of a display screen of said electronic computing tablet disposed in said interior portion, and wherein said perimeter frame prevents removal of said electronic computing tablet out from said interior portion when said first inner hinged plate is disposed in said closed position and secured, thereto, by said top lock.

2. The cashbox of claim 1 wherein said hinged top includes a front lock, and wherein said front lock is configured to secure said hinged top in said closed position.

3. The cashbox of claim 1 wherein said first inner hinged plate includes an arcuate recess in said perimeter frame, and wherein said arcuate recess is disposed over an on-off switch or over an on-off button or over an on-off control of said electronic computing tablet when said electronic computing tablet is disposed in said interior portion, and wherein said arcuate recess enables access by a user of said cashbox to said on-off switch or to said on-off button or to said on-off control of said electronic computing tablet sufficient to turn said IPAD™ or other type of electronic computing tablet on or off, as desired.

4. The cashbox of claim 1 including a second inner hinged plate that is pivotally attached to said top of said rear side member by one or more third hinges, wherein said second inner hinged plate includes a planar material, and wherein said second inner hinged plate is able to pivot between a closed position in which said second inner hinged plate is disposed over said open top of said bottom portion sufficient to cover said cash drawer when said cash drawer is disposed in said bottom portion and an open position in which said second inner hinged plate is not disposed over said top surface of said bottom portion, and wherein when said second inner hinged plate is disposed in said open position said cash drawer is lifted upward and removed from said bottom portion or lowered down and inserted into said bottom portion.

5. The cashbox of claim 1 including a hole that is provided in one of said sidewalls of said hinged top, wherein said hole is disposed over and in alignment with a port of said electronic computing tablet.

6. The cashbox of claim 5 including an extension plug, wherein said extension plug passes through said hole, and wherein said extension plug includes a first end and an opposite second end, and wherein said first end of said extension plug is inserted into said electronic computing tablet, and wherein said second end of said extension plug includes a second port, and wherein said second port is configured mechanically and electrically to receive a credit card or a debit card reading device, therein.

7. The cashbox of claim 1 wherein said cash drawer includes a plurality of slanted bill slots that each receive a particular denomination of currency, therein, and a plurality of coin compartments configured to receive a particular denomination of coin, therein.

8. The cashbox of claim 7 wherein each of said slanted bill slots includes two angled partitions that dispose any currency placed, therein, at an angle with respect to said bottom member.

9. The cashbox of claim 7 wherein each of said coin compartments includes a curvature at a bottom thereof.

10. The cashbox of claim 7 wherein a portion of one of said slanted bill slots is disposed under a portion of two of said coin compartments when a vertical line is disposed through a location that passes through said one of said slanted bill slots and also through either of said two of said coin compartments.

11. A cashbox for use with a computer tablet, comprising:

(a) a bottom portion that includes a planar bottom member and four upright opposing side members that include a rear side member, a front side member and two remaining side members, wherein said side members are attached to a perimeter of said planar bottom member and wherein said bottom portion includes an open top;

(b) a cash drawer that is sized to pass through said open top of said bottom portion and to fit into said bottom portion and to be removed apart from said bottom portion;

(c) a hinged top that is pivotally attached to a top of said rear side member by one or more first hinges, and wherein said hinged top includes four opposing sidewalls that are each disposed at a perimeter of a planar top member, and wherein a space between said four sidewalls and planar top member includes an interior portion of said hinged top, and wherein said interior portion is able to receive an electronic computing tablet therein, and wherein said hinged top is able to pivot between a closed position in which said hinged top is disposed over said bottom portion and said planar top member of said hinged top is parallel with respect to said bottom member of said bottom portion, and a partially open position in which said top member of said hinged top is disposed at a first incline with respect to said bottom member, and a fully open position in which said planar top member of said hinged top is disposed at a second incline with respect to said bottom member, and wherein said electronic computing tablet is disposed in a right-side-up orientation when said hinged top is disposed in said partially open position and wherein said electronic computing tablet is disposed in an upside-down orientation when said hinged top is disposed in said fully open position; and (d) a first inner hinged plate that is pivotally attached to said top of said rear side member by one or more second hinges, and wherein said first inner hinged plate includes a top lock and wherein said top lock is able to secure said first inner hinged plate in a closed position after said electronic computing tablet is disposed in said interior portion, and wherein when said first inner hinged plate is disposed in said closed position it is disposed adjacent to said hinged top, and wherein said first inner hinged plate includes a perimeter frame that surrounds a center opening, and wherein said center opening provides access to and viewing of a display screen of said electronic computing tablet disposed in said interior portion, and wherein said perimeter frame prevents removal of said electronic computing tablet out from said interior portion when said first inner hinged plate is disposed in said closed position and secured, thereto, by said top lock; and (e) wherein said hinged top includes a front lock, and wherein said front lock is able to secure said hinged top in said closed position, and wherein said first inner hinged plate includes an arcuate recess in said perimeter frame, and wherein said arcuate recess is disposed over an on-off switch or over an on-off button or over an on-off control of said electronic computing tablet when said electronic computing tablet is disposed in said interior portion, and wherein said arcuate recess enables access by a user of said cashbox to said on-off switch or to said on-off button or to said on-off control of said electronic computing tablet sufficient to turn said electronic computing tablet on or off, as desired, and including a second inner hinged plate that is pivotally attached to said top of said rear side member by one or more third hinges, wherein said second inner hinged plate includes a planar material, and wherein said second inner hinged plate is able to pivot between a closed position in which said second inner hinged plate is disposed over an open top of said bottom portion sufficient to cover said cash drawer when said cash drawer is disposed in said bottom portion and an open position in which said second inner hinged plate is not disposed over said open top of said bottom portion, and wherein when said second inner hinged plate is disposed in said open position said cash drawer is lifted upward and removed from said bottom portion or lowered down and inserted into said bottom portion, and including a hole that is provided in one of said sidewalls of said hinged top, wherein said hole is disposed over and in alignment with a port of said electronic computing tablet, and including an extension plug, wherein said extension plug passes through said hole, and wherein said extension plug includes a first end and an opposite second end, and wherein said first end of said extension plug is inserted into said electronic computing tablet, and wherein said second end of said extension plug includes a second port, and wherein said second port is mechanically and electrically receive a credit card or a debit card reading device, therein, and wherein said cash drawer includes a plurality of slanted bill slots that are each able to receive a particular denomination of currency, therein, and a plurality of coin compartments that receive a particular denomination of coin, therein, and wherein each of said slanted bill slots includes two angled partitions that dispose any currency placed, therein, at an angle with respect to said bottom member, and wherein each of said coin compartments includes a curvature at a bottom thereof, and wherein a portion of one of said slanted bill slots is disposed under a portion of two of said coin compartments when a vertical line is disposed through a location that passes through said one of said slanted bill slots and also through either of said two of said coin compartments.

* * * * *